US006012567A

United States Patent [19]

Ferguson et al.

[11] Patent Number: 6,012,567

[45] Date of Patent: Jan. 11, 2000

[54] DRIVE ASSEMBLY FOR A CONVEYOR

[75] Inventors: Mark Allen Ferguson, LaVergne; Dwayne Becknell, Nashville, both of Tenn.

[73] Assignee: Ecolab Inc., St. Paul, Minn.

[21] Appl. No.: 08/926,810

[22] Filed: Sep. 9, 1997

[51] Int. Cl.[7] ..... B65G 25/00

[52] U.S. Cl. ..... 198/744; 198/742

[58] Field of Search ..... 198/742, 743, 198/744, 746

[56] References Cited

U.S. PATENT DOCUMENTS

| | | | |
|---|---|---|---|
| 267,898 | 11/1882 | Jones . | |
| 2,073,521 | 3/1937 | Johnston et al. | 141/9 |
| 2,550,523 | 4/1951 | Borgerding | 198/221 |
| 2,689,639 | 9/1954 | Federighi et al. | 198/218 |
| 2,926,774 | 3/1960 | Oppermann | 198/744 X |
| 3,060,880 | 10/1962 | Laxo | 198/744 X |
| 3,382,968 | 5/1968 | Klein | 198/743 |
| 3,788,460 | 1/1974 | Messersmith | 198/221 |
| 4,622,793 | 11/1986 | Oki | 53/373 |
| 4,722,295 | 2/1988 | Young | 198/742 X |

*Primary Examiner*—William E. Terrell
*Assistant Examiner*—Gene O. Crawford
*Attorney, Agent, or Firm*—Merchant & Gould P.C.

[57] ABSTRACT

A transmission assembly capable of driving a dishwasher conveyor at different speeds to accommodate different needs, without requiring a multiple speed motor. Moreover, speed adjustments can be made without stopping the conveyor and without any risk of damage to the motor. Adjustments are effected by varying the radial distance between a driven member and an axis about which the drive assembly pivots. A detent arrangement provides a positive indication that the speed is set at a particular setting corresponding to a particular radial distance.

11 Claims, 6 Drawing Sheets

DRIVE ASSEMBLY FOR A CONVEYOR

REFERENCE TO RELATED APPLICATIONS

This application is a continuation-in-part of U.S. Ser. No. 08/650,402, filed May 20, 1996, now abandoned.

FIELD OF THE INVENTION

The present invention relates to conveyors and in particular, to an adjustable speed, drive assembly for a commercial dishwasher conveyor.

BACKGROUND OF THE INVENTION

Conveyor dishwashers are known in the art. Dishes enter one end dirty and exit an opposite end clean. A desirable attribute of such dishwashers is adjustable conveyor speed. For example, a relatively dirty load of dishes may require "more" washing than a relatively clean load. In such a case, it would be nice to run the conveyor at a relatively slow speed to effectively increase the washing time. on the other hand, with a relatively clean load, it would be nice to run the conveyor at a relatively fast speed to conserve resources. Moreover, since groups of relatively clean dishes and relatively dirty dishes may be interspersed with one another, it would be nice to adjust conveyor speed without interrupting operation of the dishwasher.

SUMMARY OF THE INVENTION

The present invention provides a transmission assembly capable of driving a dishwasher conveyor at different speeds to accommodate different needs, without requiring a multiple speed motor. Moreover, speed adjustments can be made "on the fly" (without stopping the conveyor and without any risk of damage to the motor).

Adjustments are effected by varying the radial distance between a driven member and an axis about which the drive assembly pivots. A detent arrangement provides a positive indication that the speed is set at a particular setting corresponding to a particular radial distance.

Many of the advantages of the present invention will become apparent from the detailed description of the preferred embodiment set forth below.

BRIEF DESCRIPTION OF THE DRAWINGS

With reference to the Figures of the Drawing, wherein like numerals represent like parts and assemblies throughout the several views.

DETAILED DESCRIPTION OF THE PREFERRED EMBODIMENT

Figure 1:
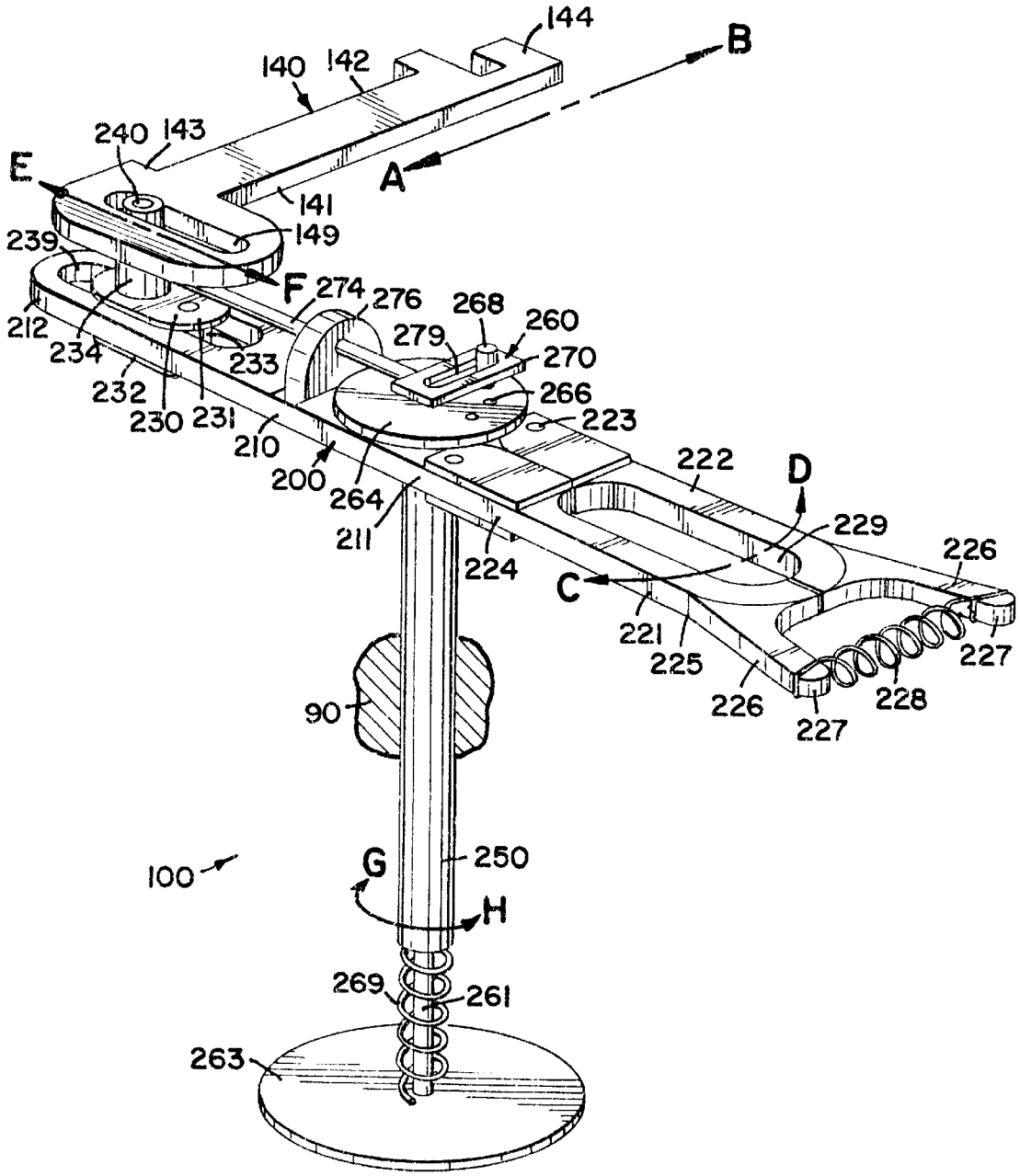
FIG. 1 is an isometric view of a drive assembly constructed according to the principles of the present invention.

A preferred embodiment drive assembly constructed according to the principles of the present invention is designated as 100 in FIGS. 1–4. The drive assembly 100 generally includes an input drive comprising a motor 120 disposed beneath the main bar 210, an output shaft 122 to which a cam 129 is eccentrically mounted, a driven member 140, and an adjustable transmission assembly 200 interconnected therebetween.

The transmission assembly 200 includes a main bar or lever 210 having a first portion or input end 211 and a second portion or output end 212 rotating about an intermediate portion 223. Two opposing arms 221 and 222 are pivotally mounted to the input end 211. The arms 221 and 222 are mirror images of one another.

The arms 221 and 222 extend from pivot ends 224 to remote ends 225. Interfacing surfaces on the input end 211 and each of the pivot ends 224 are inclined downward and away from one another, so that when in the orientation shown in FIGS. 2*b* and 3*b*, each arm 221 and 222 is free to pivot away from its counterpart, but not toward its counterpart. One of these surfaces 204 is revealed in FIG. 4. This release feature of the arms 221 and 222 allows the motor 120 to run unimpeded in the event that the conveyor link 141 and/or the lever 210 becomes jammed.

A finger 226 extends outward from each remote end 225 to a notched distal end 227, and a helical coil spring 228 is interconnected between the distal ends 227. Tension in the spring 228 biases the fingers 226 and the arms 221 and 222 toward one another. When the remote ends 225 are touching, the arms 221 and 222 cooperate to form an oval race 229 therebetween.

The input drive includes a motor 120 disposed beneath the main bar 210. The motor includes an output shaft 122, to which a cam 129 is eccentrically mounted. The cam 129 protrudes up into the oval race 229 between the arms 221 and 222. Rotation of the output shaft 122 causes the cam 129 to alternately bear against the arm 221 and the arm 222.

An oval slot 239 is formed in the main bar 210 proximate the output end or second portion 212. A sliding member 230 is slidably mounted within the slot 239 and moveable along the line EF. The sliding member includes upper and lower rims 231 and 232 and an intermediate portion 223 interconnected therebetween. The rims 231 and 232 overlap and effectively "sandwich" portions of the bar 210 to retain the sliding member 230 within the slot 239. A spacer 234, having a relatively large diameter, is mounted on-top of the upper rim 231, and a pin 240, having a relatively small diameter, protrudes upward from the top of the spacer 234.

The driven member 140 includes a link conveyor 141 which is shaped somewhat like a key. The link 141 is connected to a frame (shown diagrammatically—at 90) by means of a rectangular slot which constrains the link 141 to move linearly back and forth (along the line AB), or not at all. A shaft 142 extends transversely between a first end 143, which is generally rectangular, and a second, opposite end 144 which is generally J-shaped. An oval slot 149 is formed in the first end 143. The slot 149 is wide enough to receive the pin 240 but not the spacer 234. Both the slot 149 and the slot 239 are relatively elongate and extend parallel to one another. When moved in a first direction, toward pawl bars on a commercial dishwasher, the J-shaped end 144 engages a pawl bar and thereby drives a conveyor in a first direction. When moved in a second, opposite direction, the J-shaped end 144 comes free of the pawl bar and repositions itself relative to the conveyor. In this manner, repetitive back and forth movements of the link 141 drive the conveyor in a single direction.

Intermediate the slot 139 and the pivoting arms 221 and 222, the main bar 210 is secured to a shaft 250 which is rotatable about its longitudinal axis (indicated by the arc GH). The shaft 250 is rotatably mounted to the frame 90 by means of a trunnion or similar structure. The motor 120 rotates the bar 210 and the shaft 250 in oscillatory fashion (indicated by the arc CD), thereby causing the conveyor link 141 to move back and forth (along the line AB). Those skilled in the art will recognize that the stroke of the link 141 is a function of the distance between the axis of rotation and the linear path traveled by the link 141. If the speed of the motor 120 is constant, the speed of conveyance may nonetheless be varied by adjusting the distance between the axis of rotation and the path of the link 141. The present invention provides an adjusting means 260 for adjusting the stroke in this manner.

The adjusting means 260 includes a rod 261 which extends through the shaft 250 and the bar 210. The rod 261 has a first end connected to a knob 263 and a second, opposite end connected to a rotating plate 264. A helical coil spring 269 is compressed between the knob 263 and an end of the shaft 250 opposite the bar 210. The spring 269 biases the plate 264 toward the bar 210. Circumferentially spaced holes 266 are formed in the plate 264 at a common radial distance from the rod 261. A nub 267 protrudes upward from the bar 210 and selectively engages any one of the holes 266. The rod 261, the knob 263, and the plate 264 are free to rotate relative to the shaft 250 and the lever 210 until one of the holes 266 in the plate 264 aligns with the nub 267, at which time the bias of the spring 269 pulls the plate 264 down onto the nub 267. To rotate the plate 264 further, one must first push on the knob 263 to force the plate 264 out of engagement with the nub 267. Those skilled in the art will recognize that these parts cooperate to provide a detent arrangement.

A pin 168 extends upward from an eccentric location on the plate 264. The pin 268 protrudes through an oval race 279 in a bearing plate or member 270. A rod 274 extends between and rigidly interconnects the member 270 and the sliding member 230. An intermediate portion of the rod 274 passes through a hole in a flange 276 which extends upward from the bar 210. Since the distance between the pin 268 and the pin 240 is dictated by the rod 274, rotation of the plate 264 adjusts the stroke of the link 141 (by changing the radial distance between the pin 240 and the longitudinal axis of the shaft 250). In other words, the five holes 267 through the plate 264 allow for five discrete speed settings.

Figure 2A:
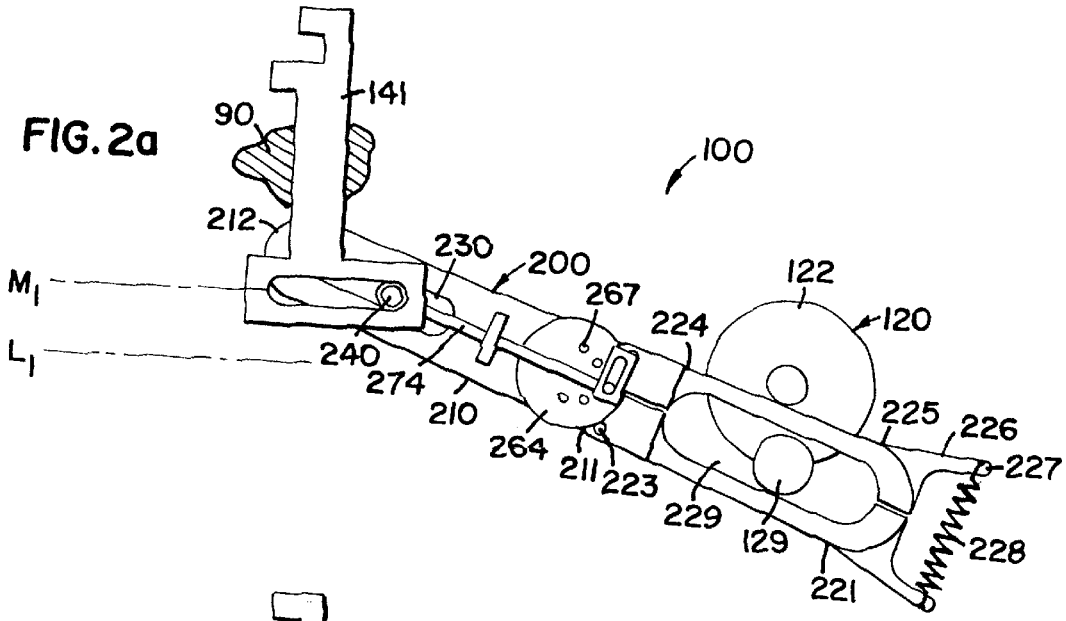
FIG. 2*a* is a top view of the drive assembly of FIG. 1, shown at a relatively low setting and in a relatively extended orientation.
Figure 2B:
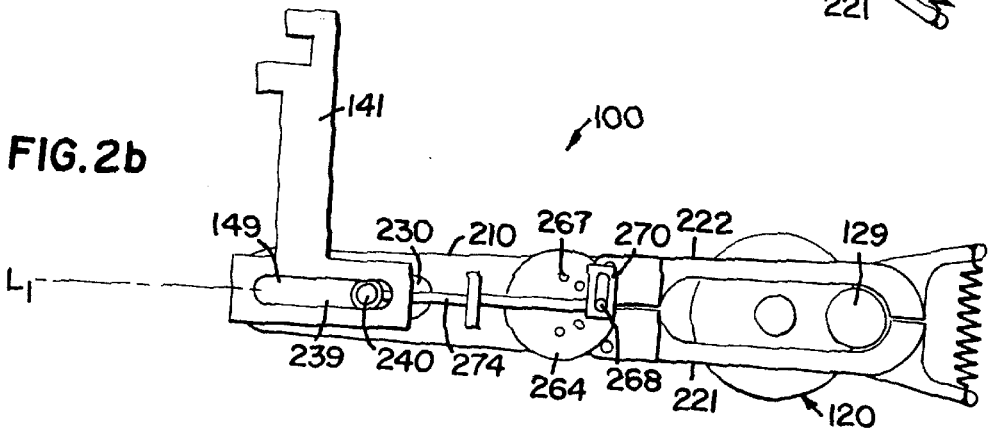
FIG. 2*b* is a top view of the drive assembly of FIG. 1, shown at a relatively low setting and in an intermediate orientation.
Figure 2C:
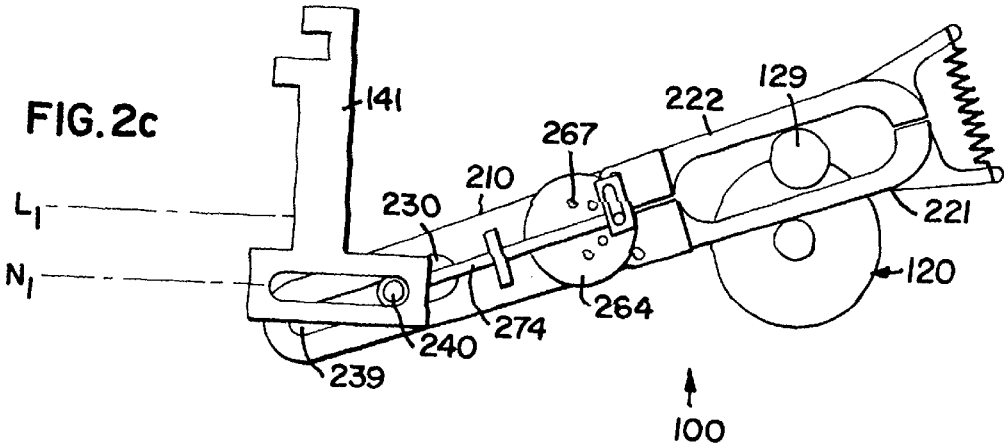
FIG. 2*c* is a top view of the drive assembly of FIG. 1, shown at a relatively low setting and in a relatively retracted orientation.
Figure 3A:
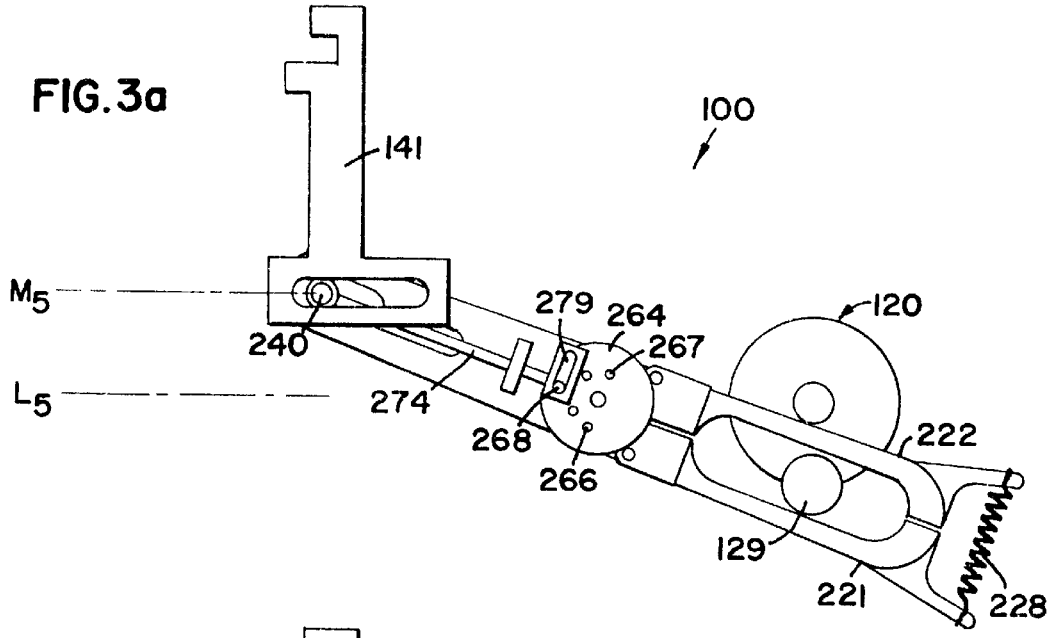
FIG. 3*a* is a top view of the drive assembly of FIG. 1, shown at a relatively high setting and in a relatively extended orientation.
Figure 3B:
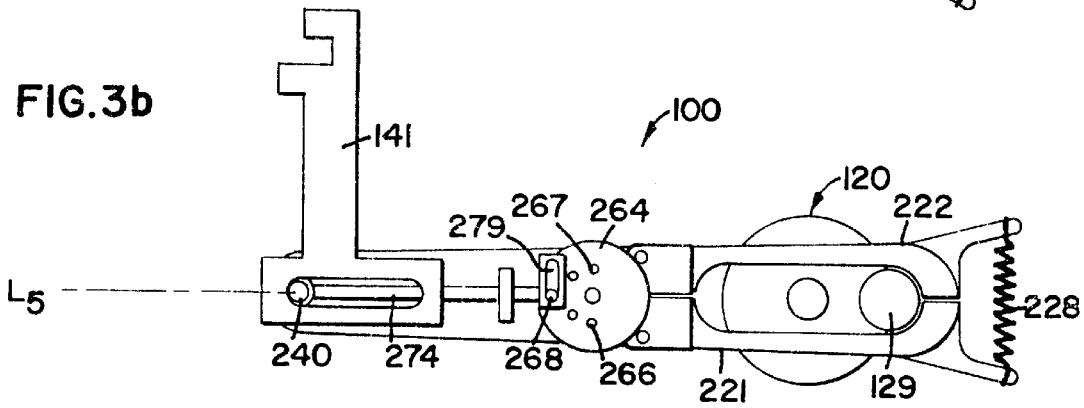
FIG. 3*b* is a top view of the drive assembly of FIG. 1, shown at a relatively high setting and in an intermediate orientation.
Figure 3C:
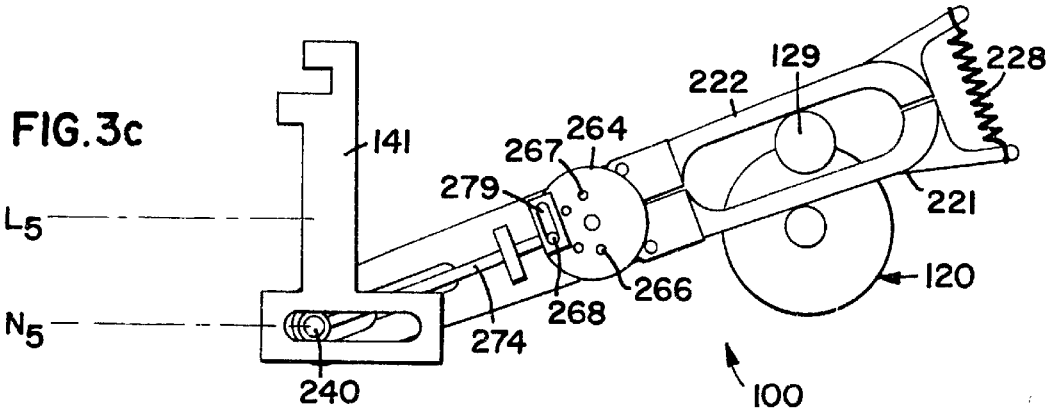
FIG. 3*c* is a top view of the drive assembly of FIG. 1, shown at a relatively high setting and in a relatively retracted orientation.
Figure 4:
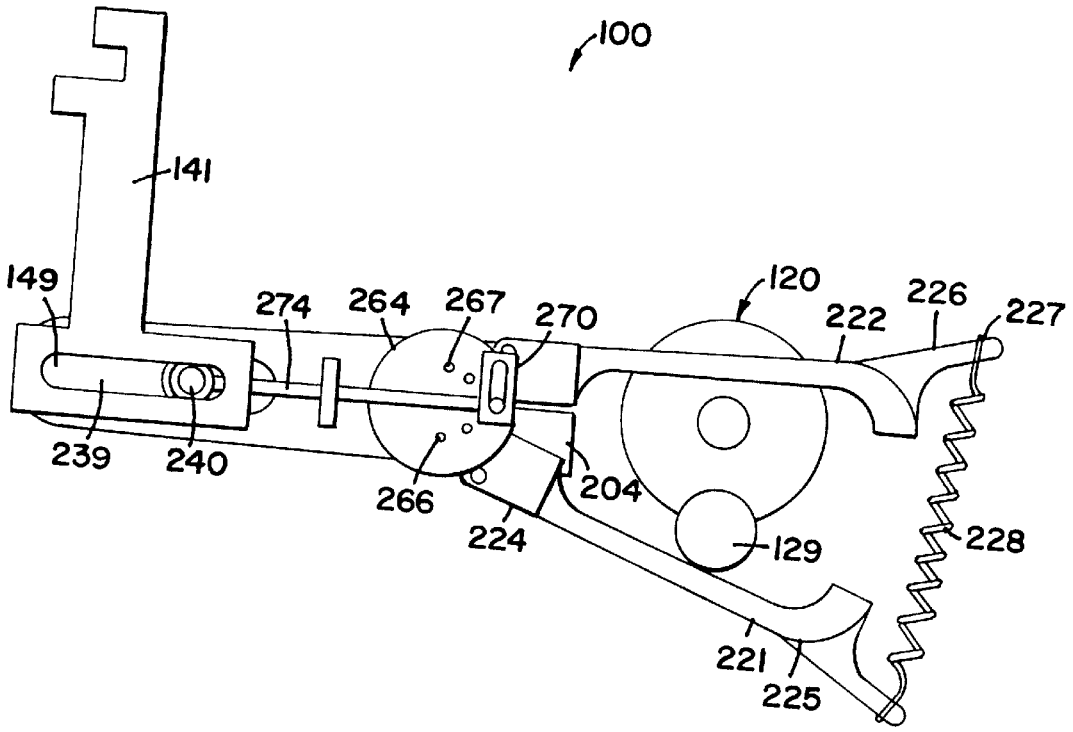
FIG. 4 is a top view of the drive assembly of FIG. 1, shown at a relatively low setting and in a jammed orientation.

With the plate 264 turned to a lowermost or minimum setting, as shown in FIGS. 2*a*–2*c*, the stroke of the link 141 is equal to the sum of the distance between the lines L1 and M1 (shown in FIG. 2*a*) and the distance between the lines L1 and N1 (shown in FIG. 2*c*). With the plate 264 turned to an uppermost or maximum setting, as shown in FIGS. 3*a*–3*c*, the stroke of the conveyor link 141 is equal to the sum of the distance between the lines L5 and M5 (shown in FIG. 3*a*) and the distance between the lines L5 and NS (shown in FIG. 3*c*). The plate 264 is shown at an intermediate setting in FIG. 1.

Those skilled in the art will recognize that the length of the race 229 must be at least as great as the diameter of the path traveled by the cam 129; the length of the slot 279 must be at least as great as the radius of the path traveled by the pin 268; the length of the slot 239 must be at least as great as the diameter of the path traveled by the pin 268, plus the length of the sliding member 230, plus the lateral component of travel of the sliding member 230 within the slot 239 upon rotation of the lever 210; and the length of the slot 149 must be at least as great as the diameter of the path traveled by the pin 268, plus the diameter of the pin 240, plus the lateral component of travel of the pin 240 within the slot 149 upon rotation of the lever 210. However, those skilled in the art will also recognize other ways to perform this same sort of adjustment, including, for example, an axially movable cable connected to the sliding member.

For ease of reference, the drive assembly 100 is described as being upright and/or viewed from above in FIGS. 1–4. However, those skilled in the art will recognize that the particular orientation of the drive assembly 100 is not critical to its operation. Moreover, the specific configurations and relative dimensions of the various parts are not necessarily vital to the utility of the present invention.

Figure 5:
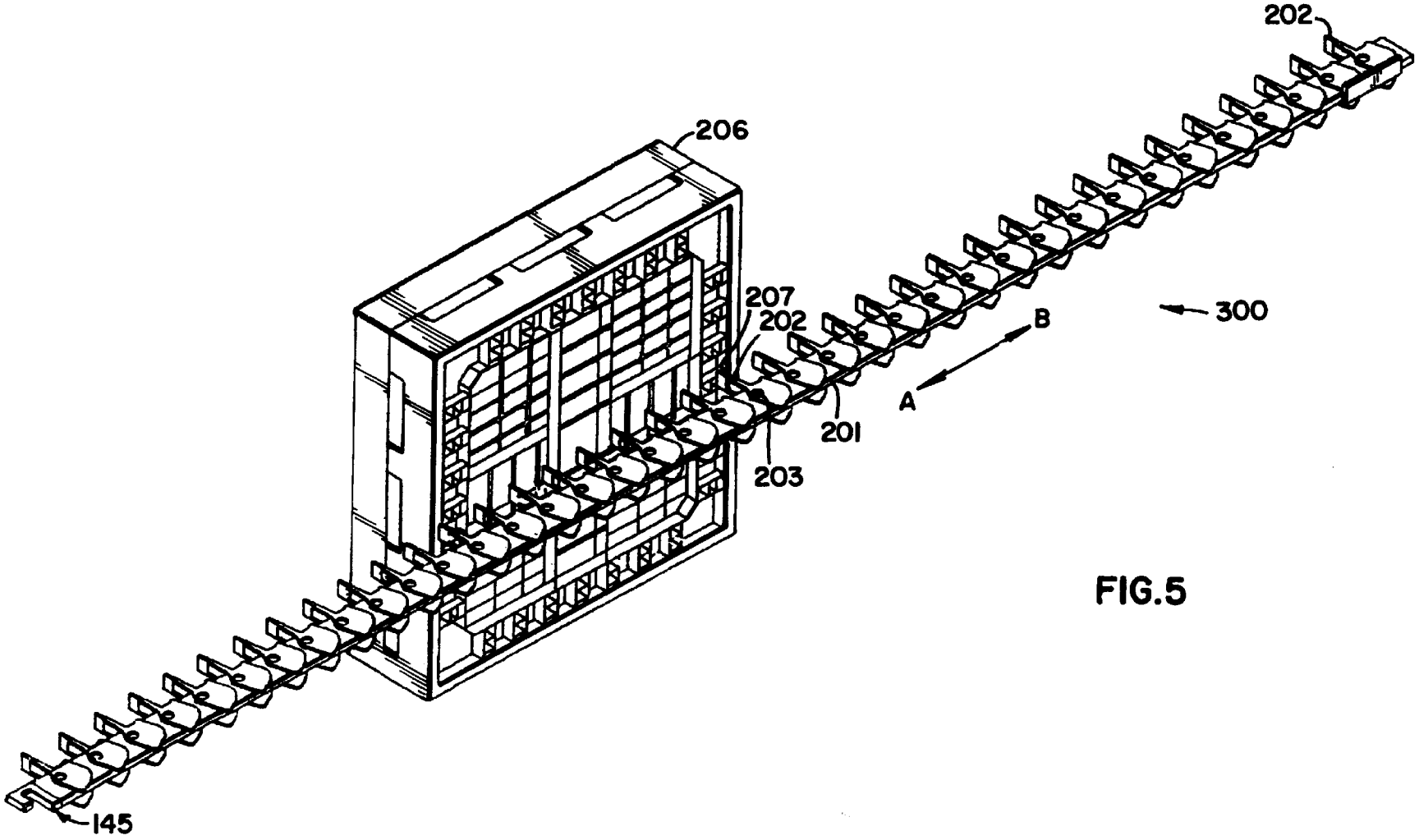
FIG. 5 is an isometric view of the pawl bar weldment, attached pawl bar dogs and associated hardware that acts to drive the conveyor. The pawl bar is driven using a conveyor-pawl bar link to the drive assembly shown in FIG. 1.

FIG. 5 is an isometric view of a movable portion of an assembly in a conveyor 300 for the movable ware container comprising a pawl bar weldment or assembly 201 having a pawl bar link 145 that is driven by the assembly of FIG. 1, specifically by the conveyor link 141 and its J-shaped member 144. Member 144 operably attaches into pawl bar link 145 and a link-wise attachment. This attachment causes the pawl bar assembly to reciprocate as the drive assembly 100 in FIG. 1 moves in the AB direction. The conveyor 300 comprises a pawl bar weldment 201 upon which is attached a series of pawl bar dogs 202. The pawl bar dogs are attached to the pawl bar weldment using pawl bar spacers 203 and associated bolts 204 and nuts 205. In use, the pawl bar weldment 201 is driven by the drive assembly 100 of FIG. 1 causing the weldment to reciprocate or move back and forth along the line AB. As the weldment 201 moves in the B direction, the pawl bar dog 202 lip portion 207 contacts the bottom of the conveyor element 206 and is advanced one incremental distance, i.e. the distance between each dog. When the weldment 201 is driven in the A direction, the dog 202, flexibly attached to the weldment 201, does not contact the conveyor firmly, but simply slides underneath the conveyor 206. When the weldment 201 is then again driven in the B direction, the dog 202 again engages the conveyor 206 with dog lip 207 to drive the conveyor 206 one additional incremental distance. The speed at which the conveyor travels is dependent on the frequency of the reciprocation in the AB direction.

Figure 6:
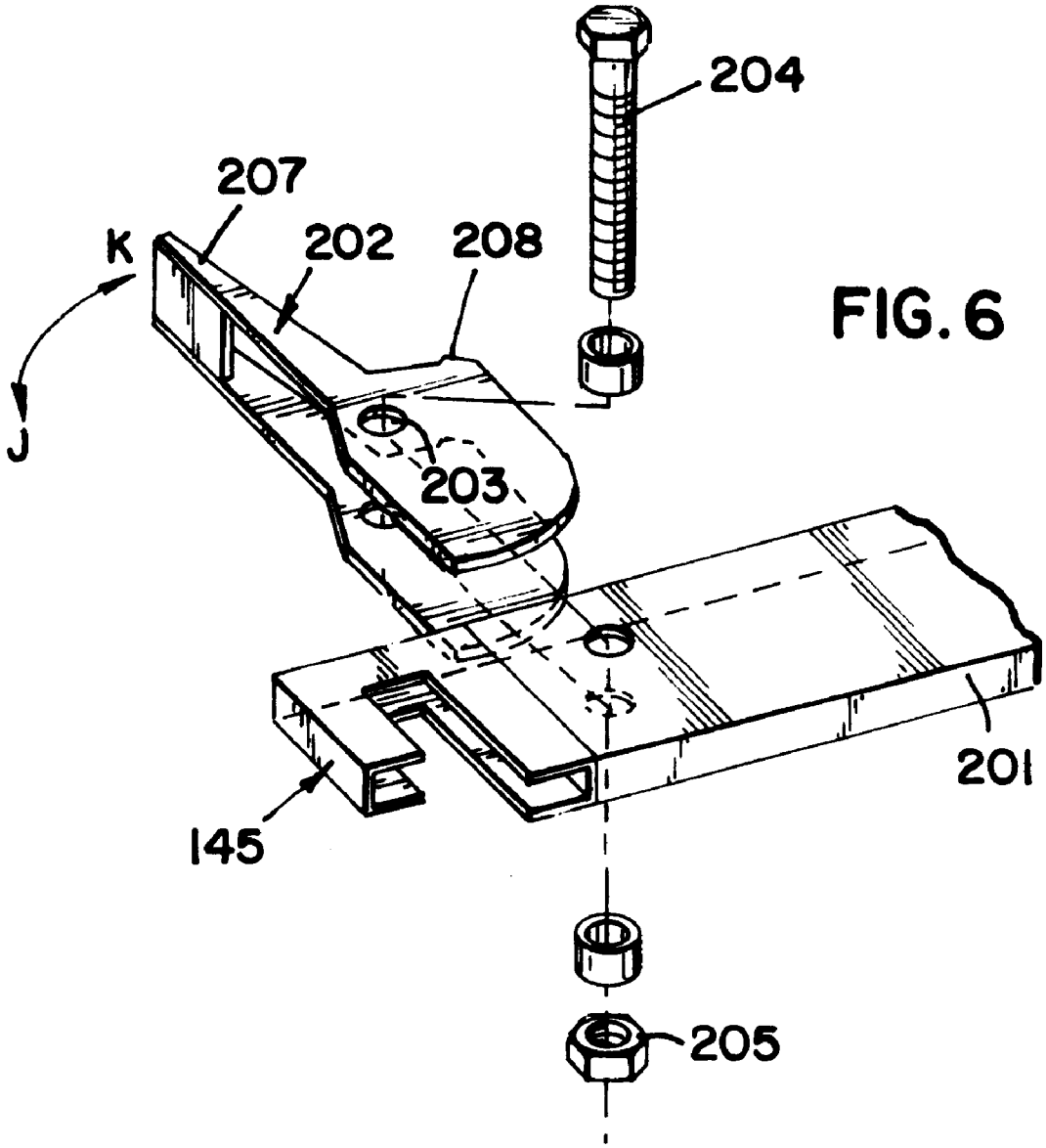
FIG. 6 is a detailed view of the conveyor-pawl bar link. The conveyor link is operably connected to pawl link which drives the pawl bar which in turn drives the conveyor.

FIG. 6 is an enlarged view of the pawl bar link end of FIG. 5. FIG. 6 shows the pawl bar weldment link 145 comprising a housing adapted to contain the link 141 and the J-shaped member of link 144. The J-shaped member 144 fits within the pawl bar length 145 to securely connect the drive mechanism 100 of FIG. 1 with the pawl bar weldment 300 of FIG. 5. Pawl bar dog 202 is additionally shown in FIG. 6. Dog 202 is permitted to rotate and travel along the line I J in concert with the AB motion of the drive assembly of FIG. 1 and the pawl bar weldment 300 of FIG. 5. The pawl bar dog is rotatably mounted on the weldment 201 using pawl bar spacer 203 fixed in place using bolt 204 and nut 205. As the pawl bar weldment 201 reciprocates along line AB, the pawl dog 202 can rotate around spacer 203 permitting limited rotating motion along line IJ. When the weldment 300 is moving in the B direction, shoulder 208 holds the dog in place and permits the dog to drive conveyor one incremental distance. When moving in direction A, the dog can rotate along arc IJ leaving the conveyor in place without movement until the dog travels fully in the A direction for movement of the conveyor in its next motion in the B direction. The reciprocating motion along line AB thus drives the conveyor incrementally in the B direction one incremental distance, i.e. the distance between the dogs, for each movement of the drive assembly.

The present invention has been described with reference to a preferred embodiment and a specific application. However, the present invention is not so limited, and those skilled in the art will recognize additional embodiments and/or applications in view of this disclosure. Accordingly, the scope of the present invention is limited only to the extent of the following claims.

What is claimed is:

1. A dish washing apparatus, comprising:

a motor;

a conveyor;

a transmission assembly interconnected between the conveyor and the motor;

an adjusting means, connected to the transmission assembly, for adjusting the speed at which the transmission assembly drives the conveyor in response to operation of the motor at a constant speed;

wherein the transmission assembly includes a lever moveable about an axis of rotation, and the adjusting means includes a member interconnected between the lever and a conveyor link and moveable radially relative to the axis of rotation;

a moving means, connected to the member, for moving the member radially relative to the axis of rotation, wherein the moving means includes a plate rotatably mounted on the lever, a pin eccentrically mounted on the plate, and a rod interconnected between the pin and the member; and incremental resilient biasing means, connected to the plate, for biasing the plate to stop at incremental changes in orientation.

2. The dish washing apparatus of claim 1, wherein the member slides relative to both the lever and the conveyor link.

3. The dish washing apparatus of claim 1, wherein the motor and the member are connected to opposite ends of the lever.

4. The dish washing apparatus of claim 1, wherein the biasing means includes a rod which interconnects the plate and a knob, and the lever and a spring are compressed between the knob and the plate, and a nub protrudes from the lever and selectively engages any of a plurality of circumferentially spaced holes in the plate.

5. The dish washing apparatus of claim 1, wherein the moving means further includes a part having a race formed therein, and the part is secured to an end of the rod opposite the member, and the pin protrudes into the race.

6. The dish washing apparatus of claim 1, wherein the transmission assembly includes a lever having a first portion, a second portion, and an intermediate portion disposed between the first portion and the second portion, wherein the intermediate portion is intersected by an axis of rotation, and the motor oscillates the first portion about the axis of rotation, and the conveyor is connected to the second portion.

7. The dish washing apparatus of claim 6, wherein a support on the second portion is connected to the conveyor and is moveable relative to both the conveyor and the second portion, in a radial direction relative to the axis of rotation.

8. A dish washing apparatus, comprising:

a lever moveable about an axis of rotation;

a motor connected to a first end of the lever;

a conveyor link;

a member interconnected between the conveyor link and a second, opposite end of the lever, wherein the member is moveable relative to both the conveyor link and the lever, in a direction radial to the axis of rotation;

a plate rotatably mounted on the lever;

a pin eccentrically mounted on the plate; and a first rod interconnected between the pin and the member, so that rotation of the plate adjusts the speed at which the transmission assembly drives the conveyor in response to operation of the motor at a constant speed.

9. The dish washing apparatus of claim 8 further comprising a part having a race formed therein, wherein the part is secured to an end of the rod opposite the member, and the pin protrudes into the race.

10. The dish washing apparatus of claim 8, further comprising:

a second rod interconnected between the plate and a knob;

a spring, wherein the lever and the spring are compressed between the knob and the plate; and a nub protruding from the lever and selectively engaging any of a plurality of circumferentially spaced holes in the plate.

11. A method of converting constant speed, rotational input from a motor into any of a plurality of conveyor speeds, comprising the steps of:

mounting a conveyor link to a frame in such a manner that the conveyor link is constrained to move linearly;

mounting a lever to the frame in such a manner that the lever is constrained to rotate about an axis of rotation;

connecting the motor to a first end of the lever; and interconnecting a second, opposite end of the lever and the conveyor link at a selectively adjustable distance from the axis of rotation; wherein the interconnecting step involves slidably connecting a sliding member within slots in the lever and the conveyor link;

rotatably mounting a plate on the lever; and interconnecting the plate and the sliding member in such a manner that rotation of the plate causes the sliding member to slide along the slots in the lever and the conveyor link;

inserting a rod through the lever and a compressed spring; connecting a first end of the rod to the plate; connecting a second, opposite end of the rod to a knob, with the knob proximate the spring, and the plate proximate the lever; disposing a nub on the lever; and forming circumferentially spaced holes in the plate in such a manner that each of the holes may be selectively aligned with the nub upon rotation of the knob.

* * * * *